US006604459B2

(12) United States Patent
Chiba et al.

(10) Patent No.: US 6,604,459 B2
(45) Date of Patent: Aug. 12, 2003

(54) PRINTER

(75) Inventors: Keiichi Chiba, Miyagi (JP); Hironobu Takasawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 43 days.

(21) Appl. No.: 09/795,482

(22) Filed: Mar. 1, 2001

(65) Prior Publication Data

US 2001/0047731 A1 Dec. 6, 2001

(30) Foreign Application Priority Data

Mar. 3, 2000 (JP) ..... 2000-058830

(51) Int. Cl.[7] ..... B41L 13/04
(52) U.S. Cl. ..... 101/116; 101/216; 101/248
(58) Field of Search ..... 101/114, 115, 101/116, 181, 216, 248

(56) References Cited

U.S. PATENT DOCUMENTS 6,382,094 B1 * 5/2002 Chiba et al. ..... 101/116

FOREIGN PATENT DOCUMENTS

JP 50116770 * 5/1993

* cited by examiner

*Primary Examiner*—Ren Yan
(74) *Attorney, Agent, or Firm*—Oblon, Spivak, McClelland, Maier & Neustadt, P.C.

(57) ABSTRACT

A printer including drive pulleys each being mounted on a particular print drum. Each of the print drums has a pitch circle diameter and a number of teeth related to each other as:

$$d/z<1$$

where d denotes the pitch circle diameter (mm) and z denotes the number of teeth.

4 Claims, 13 Drawing Sheets

PRINTER

BACKGROUND OF THE INVENTION

The present invention relates to a printer including a plurality of print drums arranged to produce a color print by passing a paper sheet or similar recording medium only once, and a device for causing a plurality of rotary members to rotate in synchronism with each other.

Today, a stencil printer capable of producing a great number of prints at low cost is extensively used. The stencil printer includes a plurality of print drums arranged side by side in a direction in which a paper sheet or similar recording medium is conveyed. The print drums each are assigned to a particular color. While a paper sheet is passed only once, an image of the first color to an image of the last color are sequentially transferred from the print drums to the paper sheet one above the other, completing a color image. While such a single pass system is more efficient than a system of the type replacing a print drum color by color, it has problems ascribable to a short distance between the print drums.

Specifically, an ink image transferred from an upstream print drum assigned to, e.g., a first color reaches the nip of a downstream print drum assigned to, e.g., a second color in a wet state. As a result, the ink image is transferred to a master or perforated stencil wrapped around the downstream print drum and then to the next paper sheet.

More specifically, the transfer of the wet ink of the first color to the master wrapped around the downstream print drum does not matter for the first paper sheet. As for the second paper sheet, however, the ink of the first color is transferred from the above master to an image of the first color transferred from the upstream print drum to the paper sheet (so-called retransfer). Retransfer, i.e., the overlap of ink of the same color is not critical in the aspect of image quality if free from positional deviation. However, if the retransferred image is deviated from the original image, an offset ghost appears on the paper sheet. For a given amount of deviation, an offset ghost causes a thick line to appear blurred and causes a thin line to appear doubled, lowering image quality to a critical degree.

Retransfer stated above is not avoidable with a single pass type of color printer. An offset ghost is, however, ascribable to the positional deviation of transfer and can therefore be accurately reduced if the upstream and downstream print drums accurately rotate in synchronism with each other for thereby conveying a paper sheet with accuracy.

To reduce an offset ghost, it has been customary to connect the upstream and downstream print drums as to drive. Japanese Patent Laid-Open Publication No. 4-329175, for example, teaches a system that connects the shafts of the print drums by using a plurality of gears. Japanese Patent Laid-Open Publication No. 7-17121, for example, proposes a system that connects the print drums by using timing pulleys and a timing belt.

The gear scheme is capable of reducing the deviation of an offset ghost. This scheme, however, uses a plurality of precision gears and therefore increases the production cost. The timing belt scheme produces an offset ghost and, moreover, aggravates deviation thereof, as will be described specifically later with reference to the accompanying drawings.

Technologies relating to the present invention are also disclosed in, e.g., Japanese Patent Laid-Open Publication No. 8-62737.

SUMMARY OF THE INVENTION

It is therefore an object of the present invention to provide a printer capable of reducing an offset ghost while using a timing belt.

It is another object of the present invention to provide a printer capable of reducing an offset ghost at low cost while using a timing belt.

In a synchronous driving device including a drive member and a driven member, drive pulleys each being mounted on one of the drive member and driven member, and a timing belt passed over the drive pulleys for causing the drive member and driven member to rotate in synchronism with each other, the drive pulleys each has a pitch circle diameter and a number of teeth related as:

$$d/z<1$$

where d denotes a pitch circle diameter and z denotes a number of teeth.

In the above configuration, the drive pulleys each may have a pitch of 3 mm or less.

Also, in accordance with the present invention, in a printer including a plurality of print drums spaced from each other in the direction of paper conveyance, toothed drive pulleys each being mounted on one of the print drums, and a timing belt passed over the toothed drive pulleys for allowing the print drums to rotate in synchronism with each other, the toothed drive pulleys each has a pitch circle diameter and a number of teeth related as:

$$d/z<1$$

where d denotes a pitch circle diameter and z denotes a number of teeth.

In the above configuration, the drive pulleys each may have a pitch of 3 mm or less.

Further, in accordance with the present invention, a device for driving a drive side and a driven side in synchronism includes a rotary member with a toothed drive pulley positioned at the drive side, a rotary member with a toothed drive pulley positioned at the driven side, and a timing belt passed over the toothed drive pulleys for causing the rotary members to rotate in synchronism with each other. The toothed drive pulleys each has a pitch circle diameter and a number of teeth related as:

$$d/z<1$$

where d denotes a pitch circle diameter and z denoted a number of teeth.

In the above construction, the drive pulleys each may have a pitch of 3 mm or less.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
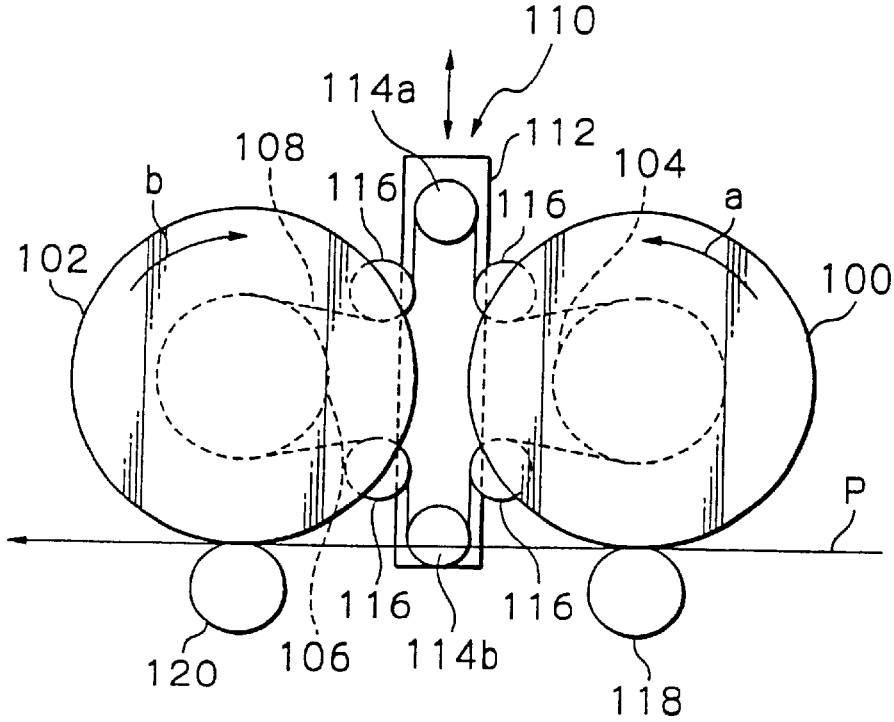
Fig. 1 PRIOR ART
FIG. 1 is a front view showing a connecting system using a timing belt included in a conventional stencil printer.

To better understand the present invention, reference will be made to a conventional single path, color stencil printer constructed to obviate offset ghosts, shown in FIG. 1. As shown, the stencil printer includes two print drums 100 and 102 spaced from each other in a direction in which a paper sheet or similar recording medium P is conveyed. The print drums 100 and 102 are respectively located at the upstream side and downstream side in the above direction. Toothed drive pulleys 104 and 106 are respectively mounted on the print drums 100 and 102, serving as timing pulleys.

A timing belt 108 is passed over the drive pulleys 104 and 106. In this configuration, the print drums 100 and 102 are driven while being connected together by the timing belt 108. A phase adjusting device 110 is positioned between the print drums 100 and 102. The phase adjusting device 110 adjusts a relative phase between the print drums 100 and 102, i.e., corrects a positional deviation between a first and a second color in the direction of paper conveyance or top-and-bottom direction.

Specifically, the phase adjusting device 110 includes a frame 112 movable up and down by being driven by drive means not shown. Toothed pulleys 114*a* and 114*b* for adjustment are rotatably mounted on the upper end and lower end of the frame 112, respectively, and held in mesh with the timing belt 108. Two pulleys 116 are fixed in place between the pulleys 114*a* and 114*b* and the print drum 100 while other two pulleys 116 are fixed in place between the pulleys 114*a* and 114*b* and the print drum 102. These pulleys 116 deflect the timing belt 108 and allow phase adjustment to be efficiently effected on the basis of the displacement of the phase adjusting means 110 in the up-and-down direction. The pulleys 116, which contact the rear surface of the timing belt 108, are implemented by spur pulleys. Press rollers 118 and 120 are movable into and out of contact with the print drums 100 and 102, respectively.

When the frame 112 and therefore the pulleys 114*a* and 114*b* for adjustment are moved upward, the print drums 100 and 102 are caused to rotate in directions a and b, respectively, and vary their phases. When the frame 112 is moved downward, the phases of the print drums 100 and 102 are varied in the opposite direction. The phase adjusting device 110 is capable of correcting a positional deviation between images to be printed on the paper sheet P in the direction of paper conveyance and is essential with a color stencil printer. The deviation is ascribable to a change in print speed by way of example.

If an upstream and a downstream print drum are connected together by a timing belt and accurately rotated in synchronism with each other, as stated above, then no offset ghosts appear on a paper sheet. In practice, however, offset ghosts appear due to various causes, as will be described hereinafter.

At the moment when the teeth of the timing belt 108 and those of the drive pulley 104 or 106 mesh with each other or when they leave each other, the angular velocity of the drive pulley 104 or 106 varies, resulting in so-called jitter. Jitter occurs once for a single tooth during rotation. Jitter increases with an increase in period with the result that the deviation of the rotation of the downstream print drum 102 from the rotation of the upstream drum 100 increases. Therefore, to reduce the deviation of the downstream print drum 102, it is necessary to provide the drive pulleys 104 and 106 with as many teeth as possible for increasing jitter frequency for a single rotation of the drive pulleys 104 and 106.

Figure 2:
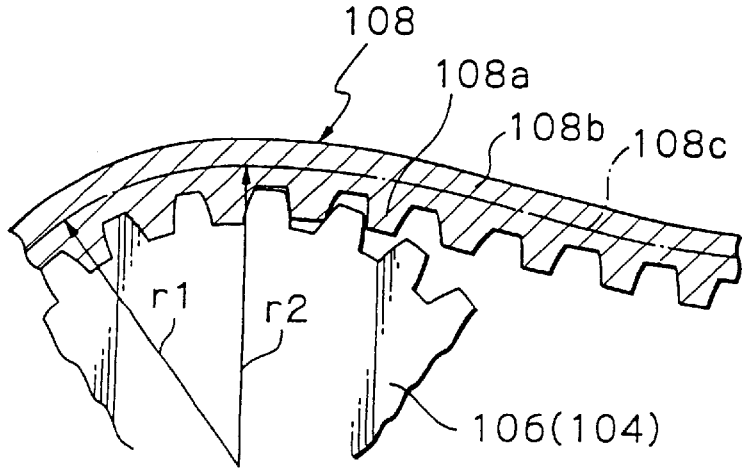
Fig. 2 PRIOR ART
FIG. 2 is a fragmentary view showing a relation between the positional deviation of a core wire included in the timing belt and the axis of a drive pulley mounted on a print drum.

Another cause of an offset ghost is irregularity in the position of a core wire included in the timing belt 108 and defining a pitch circle. The core wire guarantees drive transmission from the timing belt 108 to the drive pulleys 104 and 106. Specifically, as shown in FIG. 2, the timing belt 108 is generally made up of tooth portions 108*a*, a back portion 108*b*, and a core wire 108*c* sandwiched between the tooth portions 108*a* and the back portion 108*b*. If the core wire 108*c* is not accurately positioned, the distance between the axis of the drum pulley 104 or 106 and the core wire 108*c* varies ($r1 \neq r2$). Consequently, the rotation angle of the drive pulley 104 or 106 varies.

Figure 3:
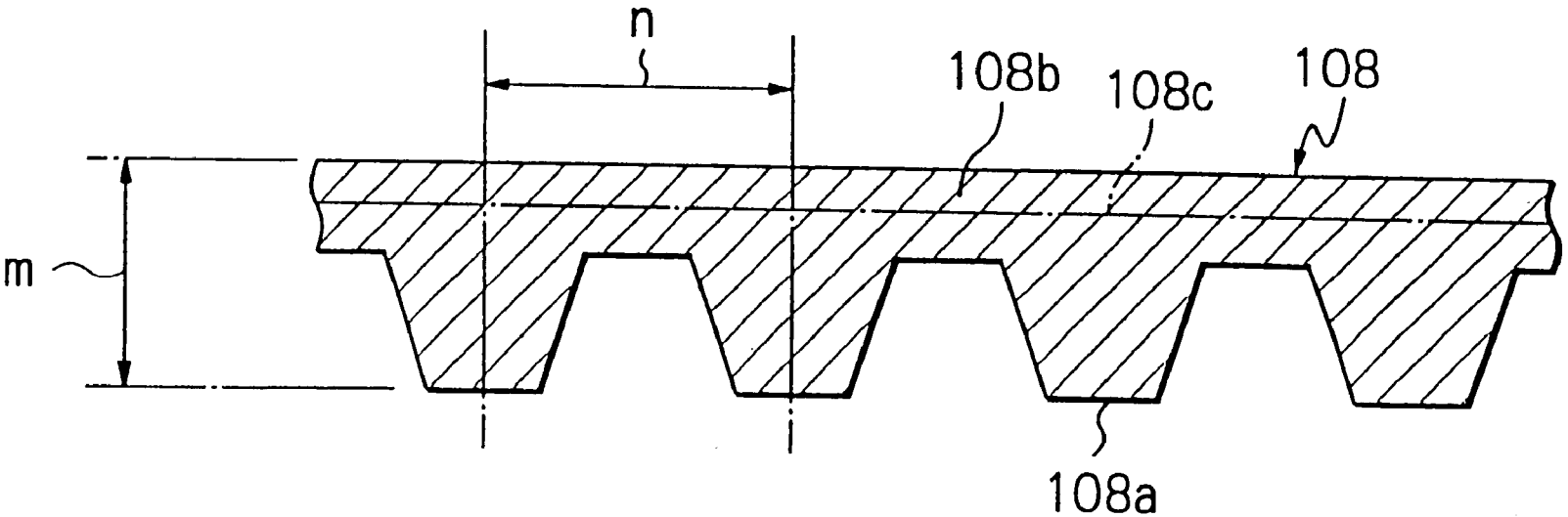
Fig. 3 PRIOR ART
FIG. 3 is a fragmentary view of the timing belt showing a relation between a pitch and the size of a tooth.

Generally, as shown in FIG. 3, the timing belt 108 has a pitch n that is a distance between nearby tooth portions 108*a*. The thickness m of the timing belt 108 increases with an increase in pitch n and makes it difficult to accurately position the core wire 108*c*. It follows that to reduce the deviation of rotation of the downstream print drum 102, a timing belt having as small a pitch as possible must be selected.

Further, in the phase adjusting device 110, the pulleys 116 contact the rear surface of the timing belt 108. Consequently, irregularities in the thickness of the timing belt 108 over the entire length of the belt 108 aggravate eccentricity.

Moreover, the drive pulleys 104 and 106 and pulleys 114*a* and 114*b* each involves some eccentricity due to limited machining accuracy and assembling accuracy. As for the drive pulleys 104 and 106, eccentricity does not disturb the synchronous rotation of the print drums 100 and 102 because an offset ghost appears only once for a single rotation of the print drums 100 and 102, i.e., a single rotation of the drive pulleys 104 and 106. However, the eccentricity of the pulleys 104*a* and 104*b* disturbs the relative phase between the print drums 100 and 102 every time the pulleys 114*a* and 114*b* rotate or, when the timing belt 108 involves an eccentricity component, every time the drive pulleys 104 and 106 rotate. Why an offset ghost appears when the pulleys 114*a* and 114*b* are eccentric will be described hereinafter with reference to FIGS. 4 and 5.

Figure 4:
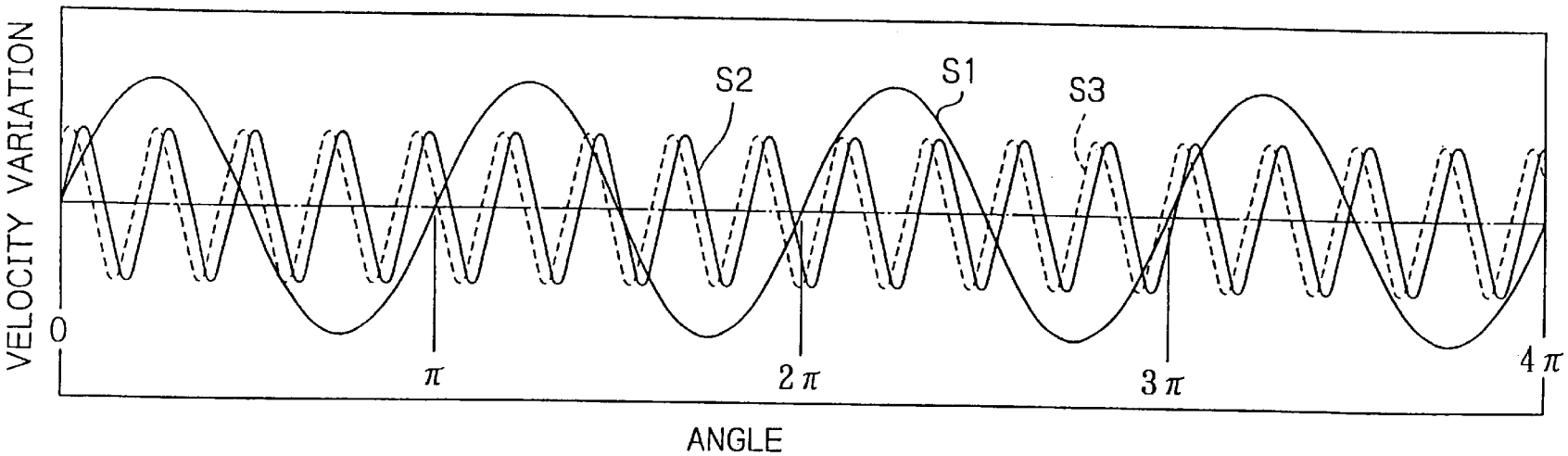
Fig. 4 PRIOR ART
FIG. 4 is a graph showing velocity variations to occur when a pulley for adjustment, for example, is eccentric.

Assume that the ratio of the number of teeth of the drive pulley 104 or 106 to that of the pulley 114*a* or 114*b* is 4.3:1, i.e., the former is a non-integral multiple of the latter. Also, assume that the drive pulley 104 or 106 and pulley 114*a* or 114*b* are eccentric. FIG. 4 shows waveforms representative of the velocity variations of only the drive pulley 104 and pulley 114*a* by way of example measured under the above conditions. Specifically, a solid waveform S1 shows the velocity variation of the drive pulley 104. A solid waveform S2 shows the velocity variation of the pulley 114*a*; the origin of the waveform S2 is shown as being coincident with the origin of the waveform S1 for better understanding the relation. A phantom waveform S3 shows the velocity variation of the pulley 114*a* occurred when the drive pulley 104 and pulley 104*a* were different from each other in the position of eccentricity. As the waveform S3 indicates, the waveform of the pulley 114*a* has an origin that is, in many cases, not coincident with the original of the waveform of the drive pulley 104.

Figure 5:
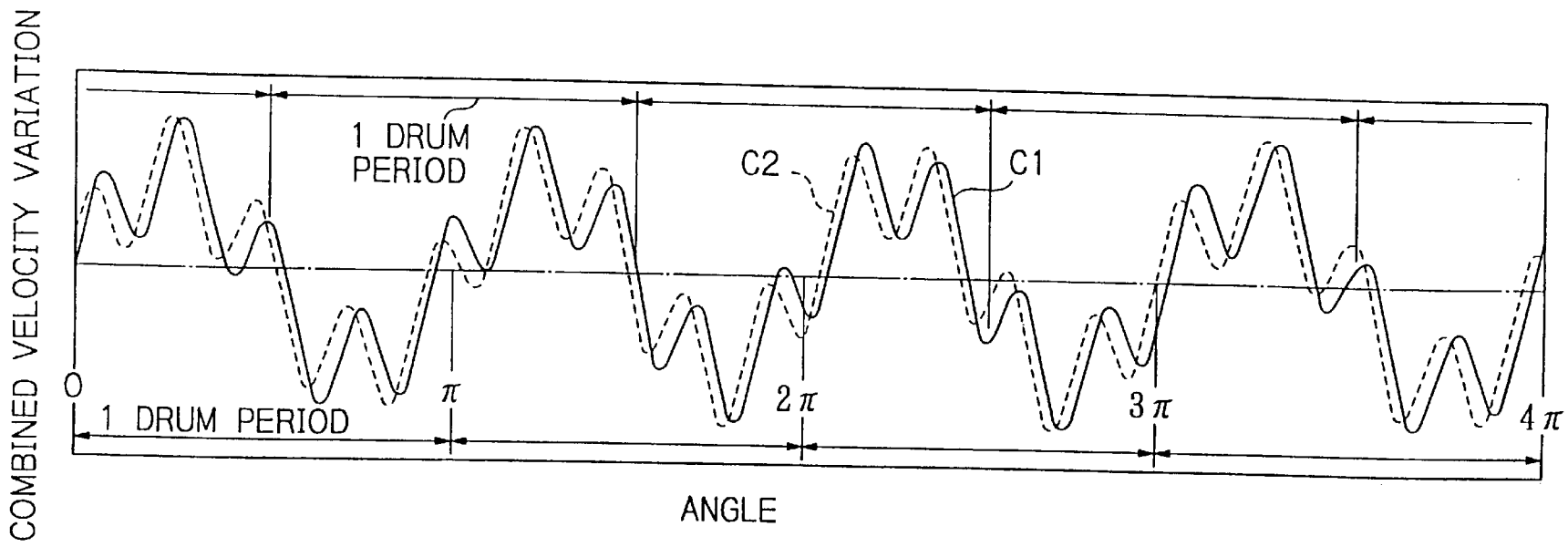
Fig. 5 PRIOR ART
FIG. 5 is a graph showing combined waveforms derived from the waveforms of FIG. 4.

FIG. 5 shows a solid waveform C1, which is a combined form of the waveforms S1 and S2 of FIG. 4, and a phantom waveform C2, which is a combined form of the waveforms S1 and S3 of FIG. 4. As shown, wherever one drum period may begin, the velocity varies in a different manner every period. Consequently, the deviation between the print drums 100 and 102 varies in a different manner every period, resulting in an offset ghost.

Figure 6:
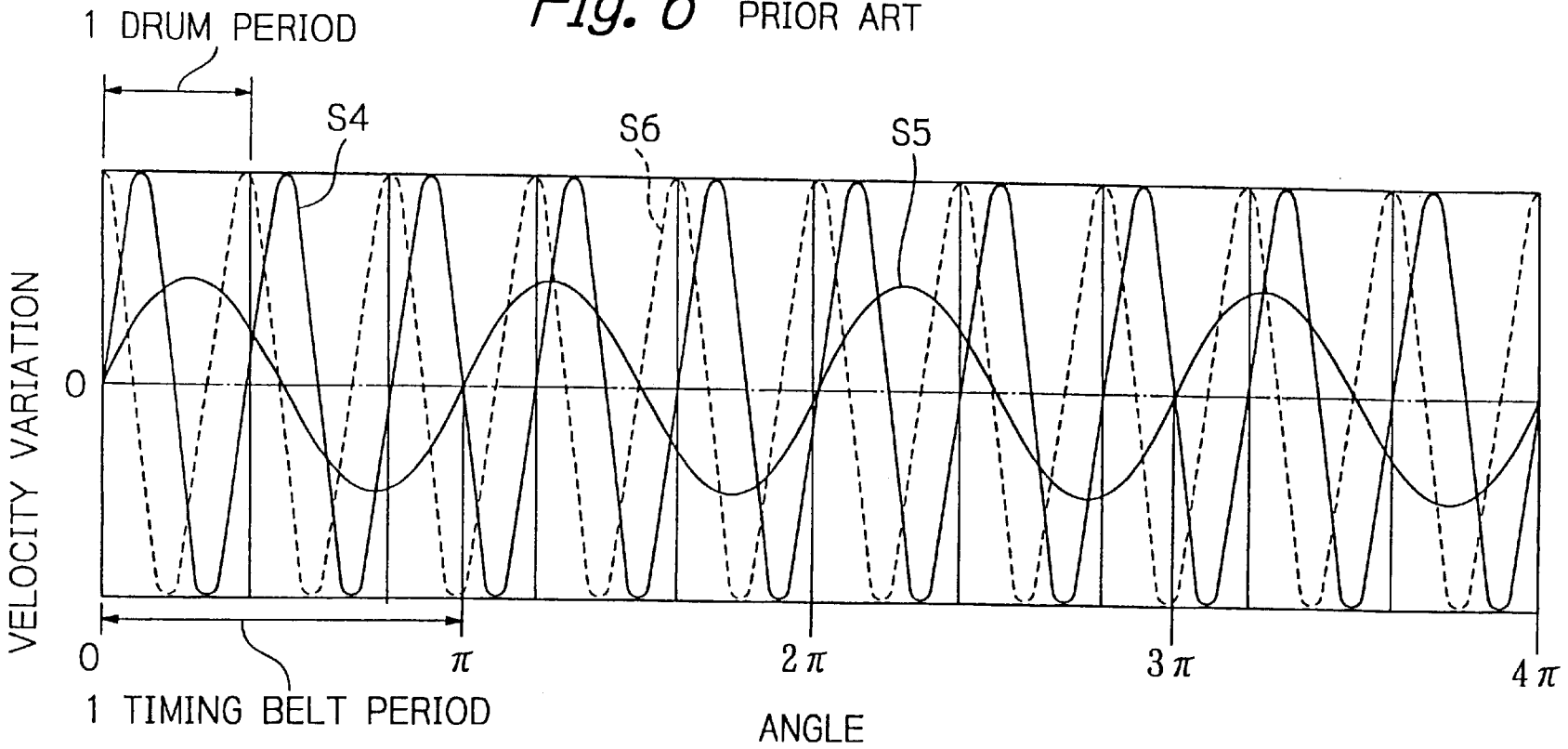
Fig. 6 PRIOR ART
FIG. 6 is a graph showing velocity variations to occur when the drive pulley and a timing belt are eccentric.
Figure 7:
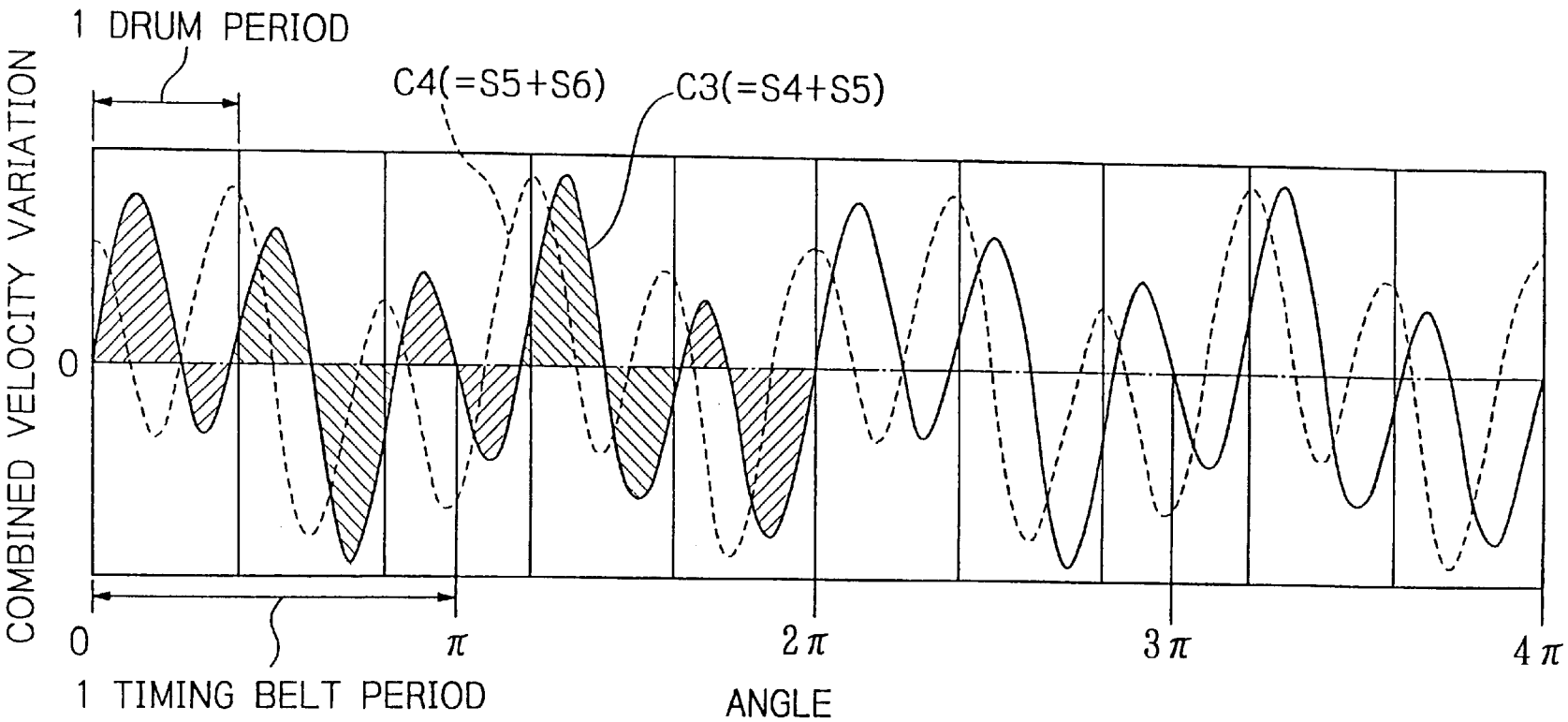
Fig. 7 PRIOR ART
FIG. 7 is a graph showing combined waveforms derived from the waveforms of FIG. 6.
Figure 8:
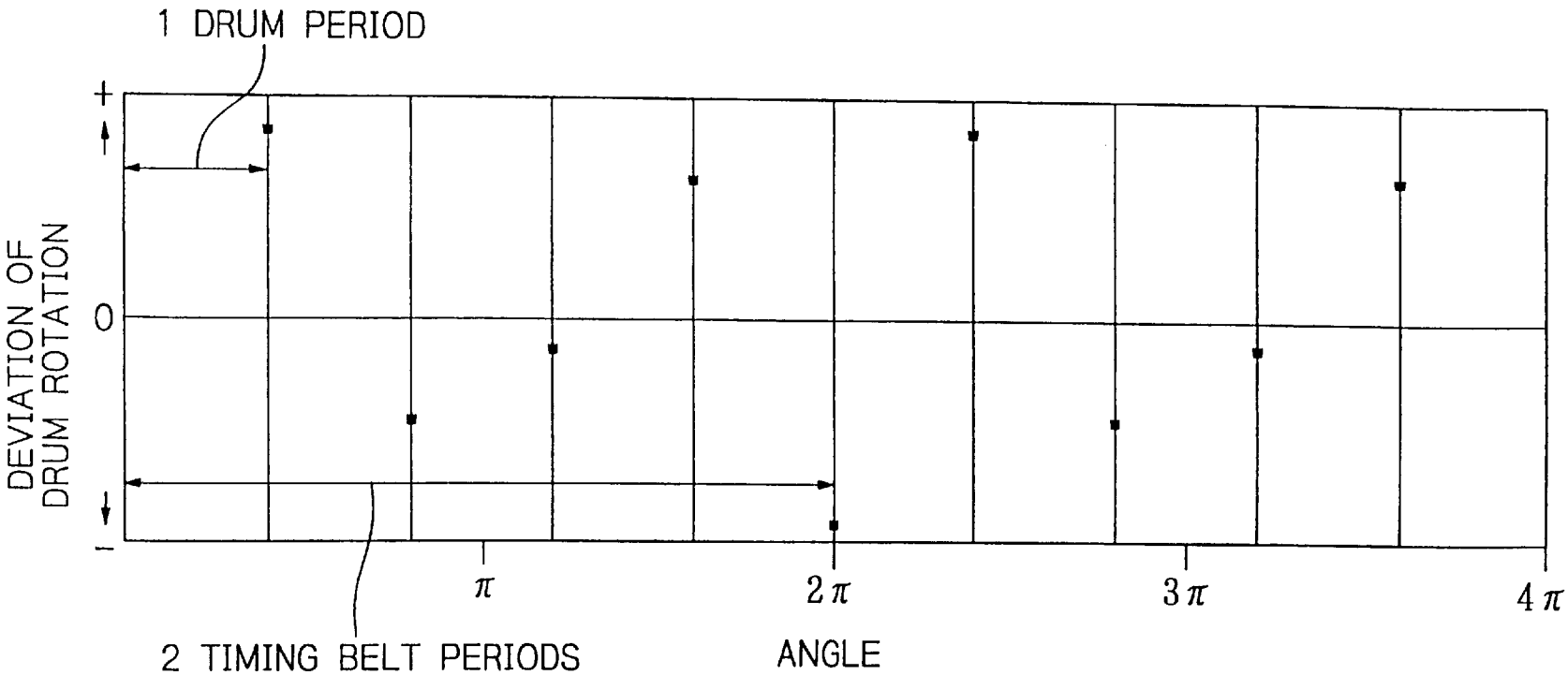
Fig. 8 PRIOR ART
FIG. 8 is a graph plotting the deviations of rotation of a print drum in terms of the sum of areas derived from the waveforms of FIG. 7.

Reference will be made to FIGS. 6 through 8 for describing an offset ghost ascribable to the eccentricity of the timing belt 108. Assume that the ratio of the number of teeth of the drive pulley 104 or 106 to that of the timing belt 108 is 1:2.5, i.e., the latter is a non-integral multiple of the former. Also, assume that the drive pulley 104 or 106 and timing belt 108 are eccentric. FIG. 6 shows waveforms representative of the velocity variations of only the drive pulley 106 and timing belt 108 by way of example measured under the above conditions.

In FIG. 6, a solid waveform S4 shows the velocity variation of the drive pulley 106. A solid waveform S5 shows the velocity variation of the timing belt 108; the origin of the waveform S5 is shown as being coincident with the origin of the waveform S4 for better understanding the relation. A phantom waveform S6 shows the velocity variation of the drive pulley 106 occurred when the drive pulley 106 and timing belt 108 were different from each other in the position of eccentricity. As the waveform S6 indicates, the waveform of the drive timing belt 108 has an origin that is, in many cases, not coincident with the original of the waveform of the drive pulley 106.

FIG. 7 shows a solid waveform C3, which is a combined form of the waveforms S4 and S5 of FIG. 6, and a phantom waveform C4, which is a combined form of the waveforms S5 and S6 of FIG. 6. As shown, wherever one period begins, the velocity varies in a different manner every period. However, the timing belt 108 and drive pulley 106 respectively have two periods and five periods because of the preselected relation in the number of teeth. The waveform C3 therefore has the same pattern repeating every five periods of the drive pulley 106.

FIG. 8 plots the sums of the areas of hatched portions shown in FIG. 7 that occur during every period of the drive pulley 106. Each sum indicates a particular deviation of the synchronism of the drive pulley 106. It will be seen that the synchronism of the drive pulley 106 repeatedly deviates by the same amount every two periods of the timing belt 108.

Generally, gears, a timing belt and so forth that connect print drums involve some eccentricity do to limited machining accuracy, so that velocity unavoidably varies during one rotation. A gear train connecting print drums is highly rigid and allows the deviation of an offset ghost to be reduced if the accuracy of the individual gear is increased. However, using a plurality of precision gears is undesirable from the cost standpoint.

On the other hand, a timing belt connecting print drums reduces the overall cost because timing pulleys or similar low-cost parts, which can be produced by injection molding or similar technology on a quantity basis, suffice. This, however, brings about the previously discussed problem that the eccentricity of the timing belt and timing pulleys aggravates the deviation of an offset ghost.

The problems stated above are not particular to a printer, but also occur in any other synchronous drive system in which a timing belt connects a drive member and a driven member.

As stated above, to reduce the deviation of rotation of a downstream print drum, it is necessary to provide each drive pulley with as many teeth as possible and to raise jitter frequency during one rotation of the drive pulley. To enhance the positional accuracy of a core wire, a timing belt whose pitch is as small as possible is required. These are the rough measures against an offset ghost ascribable to a connecting system using a timing belt. However, when it comes to a thin timing belt having a small pitch, another problem is brought about as to, e.g., durability in the event of heavy-load drive. The reduction of an offset ghost from this standpoint has not been addressed to yet.

Figure 9:
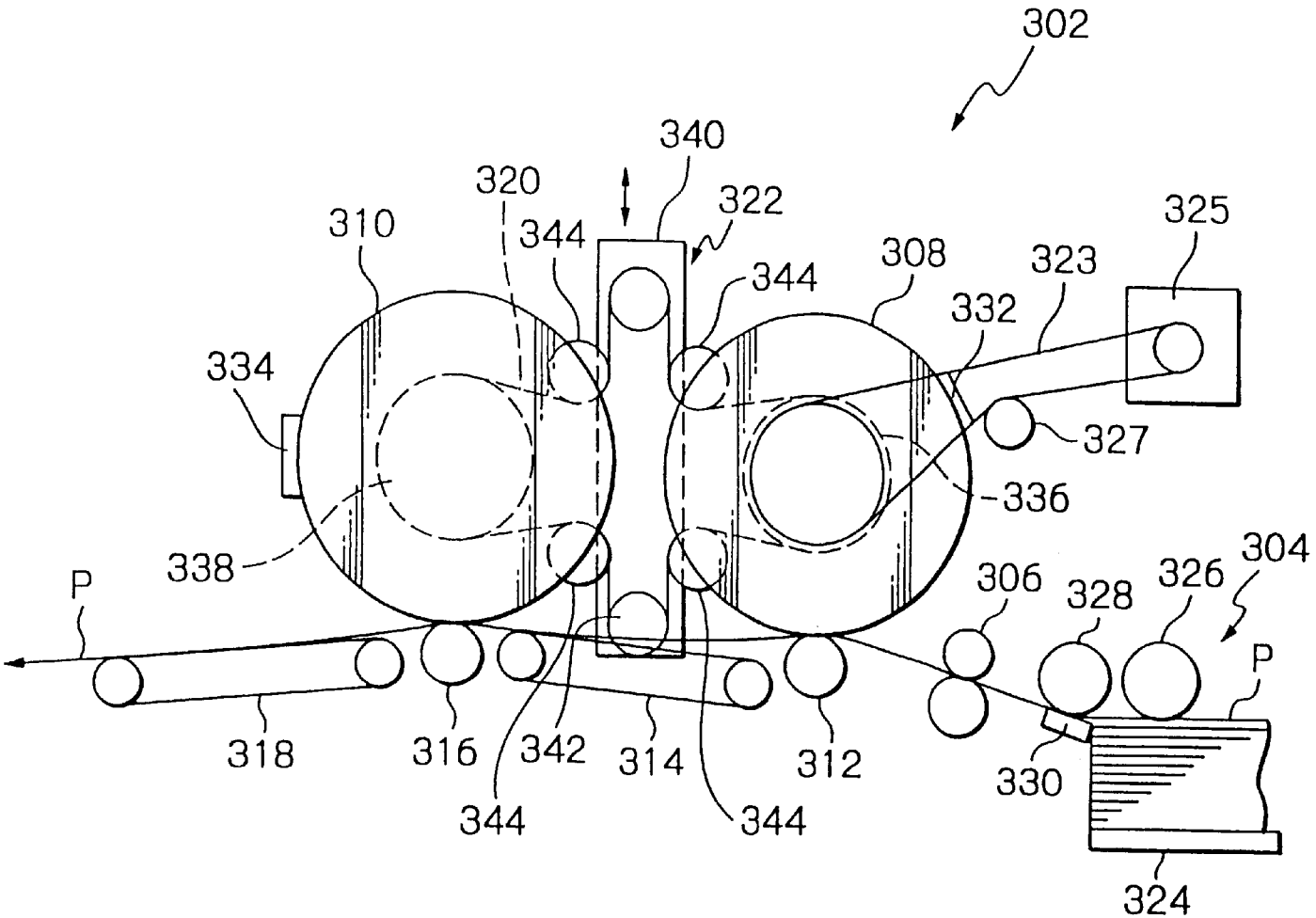
FIG. 9 is a front view showing a printer or a synchronous driving device embodying the present invention and implemented as a stencil printer by way of example.

Referring to FIG. 9, a stencil printer embodying the present invention and representative of a printer or a synchronous driving device will be described. As shown, the stencil printer, generally 302, includes two print drums 308 and 310. Paper feeding means 304 feeds a paper sheet P toward the print drums 308 and 310 via a registration roller pair 306. The print drums 308 and 310 are spaced from each other in the direction in which the paper sheet P is conveyed. A moving mechanism, not shown, moves a press roller 312 into and out of contact with the upstream print drum 308. Intermediate conveying means 314 is positioned between the print drums 308 and 310 for conveying the paper sheet P and includes an endless belt. A moving mechanism, not shown, moves a press roller 316 into and out of contact with the downstream print drum 310. Outlet conveying means 318 conveys the paper sheet P peeled off from the print drum 310 to a print tray not shown. A timing belt 320 connects the print drums 308 and 310. Phase adjusting means adjusts a relative phase between the print drums 308 and 310.

A main motor 325 causes the upstream print drum, or drive member, 308 via a main drive belt 323. The rotation of the print drum 308 is transmitted to the downstream print drum, or driven member, 310 via the timing belt 320. A pulley 327 applies tension to the main drive belt 323.

The paper feeding means 304 includes a tray 324 loaded with a stack of paper sheets P and intermittently movable upward. A pickup roller 326, a separator roller 328 and a separator pad 330 cooperate to pay out the top paper sheet P from the tray 324 toward the registration roller pair 306.

The registration roller pair 306 corrects, e.g., the skew of the paper sheet P. The roller pair 306 then drives the paper sheet P toward the print drum 308 at such a timing that the leading edge of the paper sheet P meets the leading edge of an image formed on the print drum 308.

Ink feeding means, not shown, is arranged within the print drum 308 and feeds ink of a first color to the inner periphery of the drum 308. The press roller 312 presses the paper sheet P arrived at the print drum 308 against the drum 308 via a master, which is wrapped around the drum 308. As a result, the ink is transferred to the paper sheet P via the porous portion of the print drum 308 and perforations formed in the master, printing an image on the paper sheet P in the first color. The press roller 312 is intermittently pressed against the print drum 308 so as not to interfere with a master damper 332 mounted on the drum 308.

Peeling means peels off the paper sheet P carrying the image thereon from the print drum 308. Subsequently, the previously mentioned belt included in the intermediate conveying means 314 conveys the paper sheet. At this instant, a fan also included in the conveying means 314 sucks the paper sheet P to thereby retain the paper sheet P on the belt. The conveying means 314 conveys the paper sheet P at a linear velocity preselected times higher than the linear velocity of the paper sheet P.

Ink feeding means, not shown, is also arranged within the print drum 310 and feeds ink of a second color to the inner periphery of the drum 310. As the paper sheet P with the image of the first color arrives at a nip between the downstream print drum 310 and the press roller 316, the roller 316 presses the paper sheet P against the drum 310. As a result, the ink is transferred to the paper sheet P via the porous portion of the print drum 308 and perforations formed in the master, printing an image on the paper sheet P in the second color over the image of the first color. The press roller 316 is intermittently pressed against the print drum 310 so as not to interfere with a master damper 334 mounted on the drum 310.

Peeling means, not shown, peels off the paper sheet or bicolor print P from the print drum 310. Subsequently, a belt included in the outlet conveying means 318 conveys the bicolor print P to the print tray not shown. At this instant, a fan also included in the conveying means 318 sucks the print P to thereby retain it on the belt.

Figure 10:
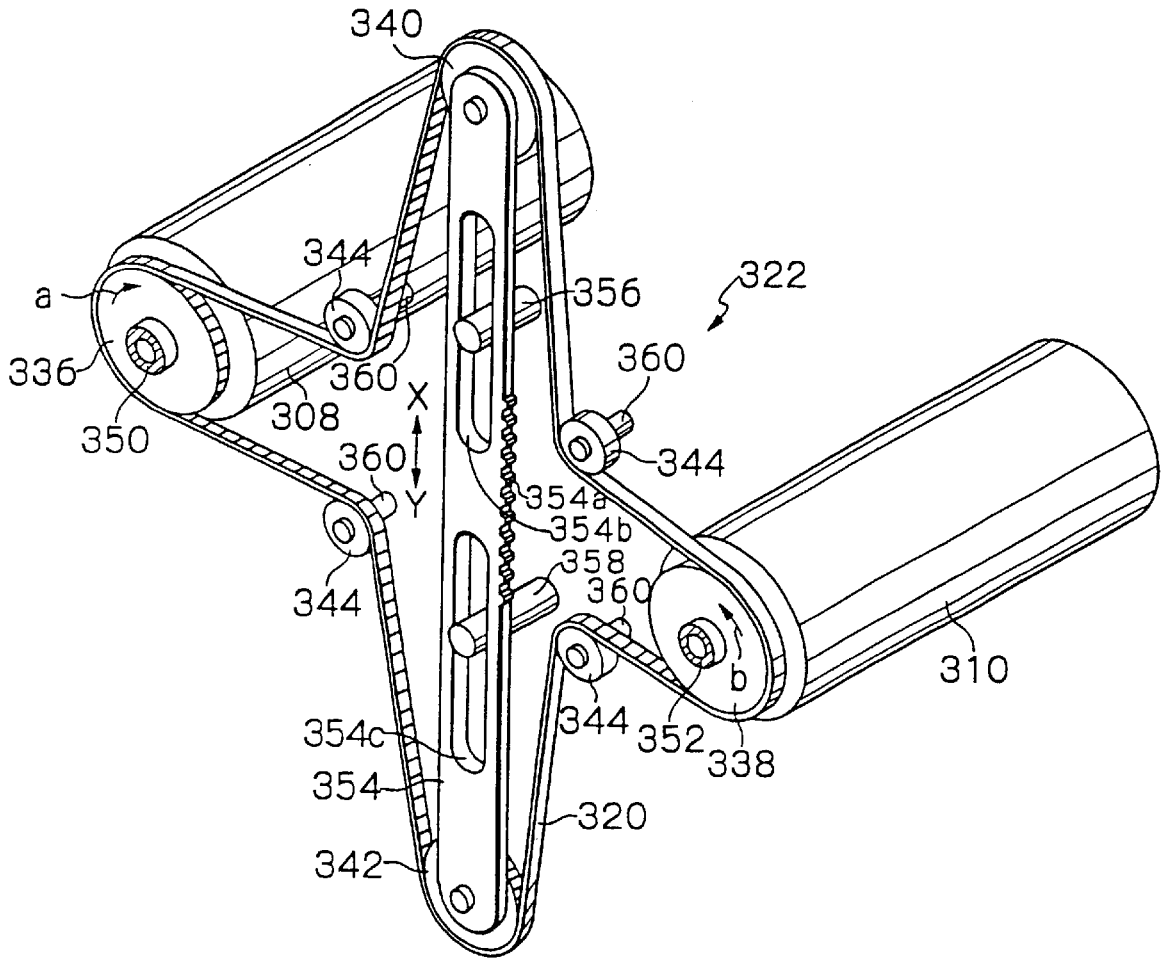
FIG. 10 is an isometric view showing a phase adjusting device included in the illustrative embodiment.

As shown in FIG. 10, the print drums 308 and 310 are mounted on shafts 350 and 352, respectively. Toothed drive pulleys, or timing pulleys, 336 and 338 are respectively mounted on the rear ends of shafts 350 and 352 (front ends as viewed in FIG. 10) such that the print drums 308 and 310 are replaceable. A timing belt 320 is passed over the drive pulleys 336 and 338.

The phase adjusting means 322 includes a frame 354 elongate in the up-and-down direction. An upper pulley 340 and a lower pulley 342 for adjustment are respectively mounted on the upper end and lower end of the frame 354, playing the role of timing pulleys. Four pulleys 344 are fixed in place between the pulleys 340 and 342 and the drive pulleys 336 and 338, as illustrated. The pulleys 344 allow the relative phase to be efficiently adjusted by a small displacement of the frame 354. The pulleys 344 play the role of tension pulleys at the same time. The phase adjusting means 322 additionally includes a rack 354*a* formed in the frame 354, a pinion, not shown, meshing with the rack 354*a*, and a motor, not shown, for driving the pinion.

As shown in FIG. 10, elongate slots 354*b* and 354*c* are respectively formed in the upper portion and lower portion of the frame 354, and each extends in the up-and-down direction. Guide pins 356 and 358 are studded on a sidewall, not shown, included in the printer body. The guide pins 356 and 358 are received in the slots 354*b* and 354*c*, respectively. The frame 354 is movable up and down while being guided by the guide pins 356 and 358 and guide members, not shown, affixed to the sidewall of the apparatus body.

The pulleys, or spur pulleys, 344 each are rotatably mounted on a respective shaft 360 affixed to the sidewall of the printer body. The pulleys 344 contact the rear surface of the timing belt 320 while squeezing the belt 320, as illustrated.

Assume that the pinions, not shown, are rotated to cause the frame 354 to move upward in a direction X. Then, the pulleys 340 and 342 are moved upward together with the frame 354, causing the print drums 308 and 310 to rotate in directions a and b, respectively. As a result, a relative phase between the print drums 208 and 310 varies so as to correct a positional deviation between the first and second colors. When the pinion is rotated in the opposite direction, the frame 354 is moved downward in a direction Y and effects phase adjustment in the opposite direction.

The drive pulleys 336 and 338 have the same number of teeth, which is greater than the number of teeth of the pulleys 340 and 342 included in the phase adjusting means 322. The pulleys 340 and 342 have the same number of teeth.

In the illustrative embodiment, the drive pulleys 336 and 338 each has a pitch circle whose diameter is smaller than 1 when divided by the number of teeth, i.e., smaller than the number of teeth. The timing belt 320 has a pitch of 3 mm or less. These conditions were derived from the following experiments.

In a first experiment, the print drums 308 and 310 each had a diameter of 180 mm while the drive pulleys 336 and 338 each had a pitch circle diameter of 152.79 mm and ninety-six teeth (pitch of 5 mm). The maximum deviation of rotation of the downstream drive pulley 338 was 0.17 mm, as measured at the pitch circle diameter portion of the pulley 338. In a second experiment, the print drums 308 and 310 each had a diameter of 180 mm while the drive pulleys 336 and 338 each had a pitch circle diameter of 137.51 mm and 144 teeth (pitch of 3 mm). The maximum deviation of rotation of the downstream drive pulley 338 was 0.1 mm, as measured at the pitch circle diameter portion of the pulley 338.

The results of the first and second experiments indicate that what is important for the reduction of an offset ghost is to provide the drive pulleys 336 and 338 or the timing belt 320 with a small pitch.

How the pitch circle diameter of the drive pulleys 336 and 338 and the pitch of the timing belt 320 should be selected will be described hereinafter. Assume that a plurality of print drums are interconnected by a timing belt, and that the upstream and downstream drums should be accurately synchronized to each other. Then, the greater the pitch circle diameter of the drive pulleys, the smaller the influence of the deviation ascribable to the timing belt on an image. This will be described with reference to FIG. 11.

Figure 11:
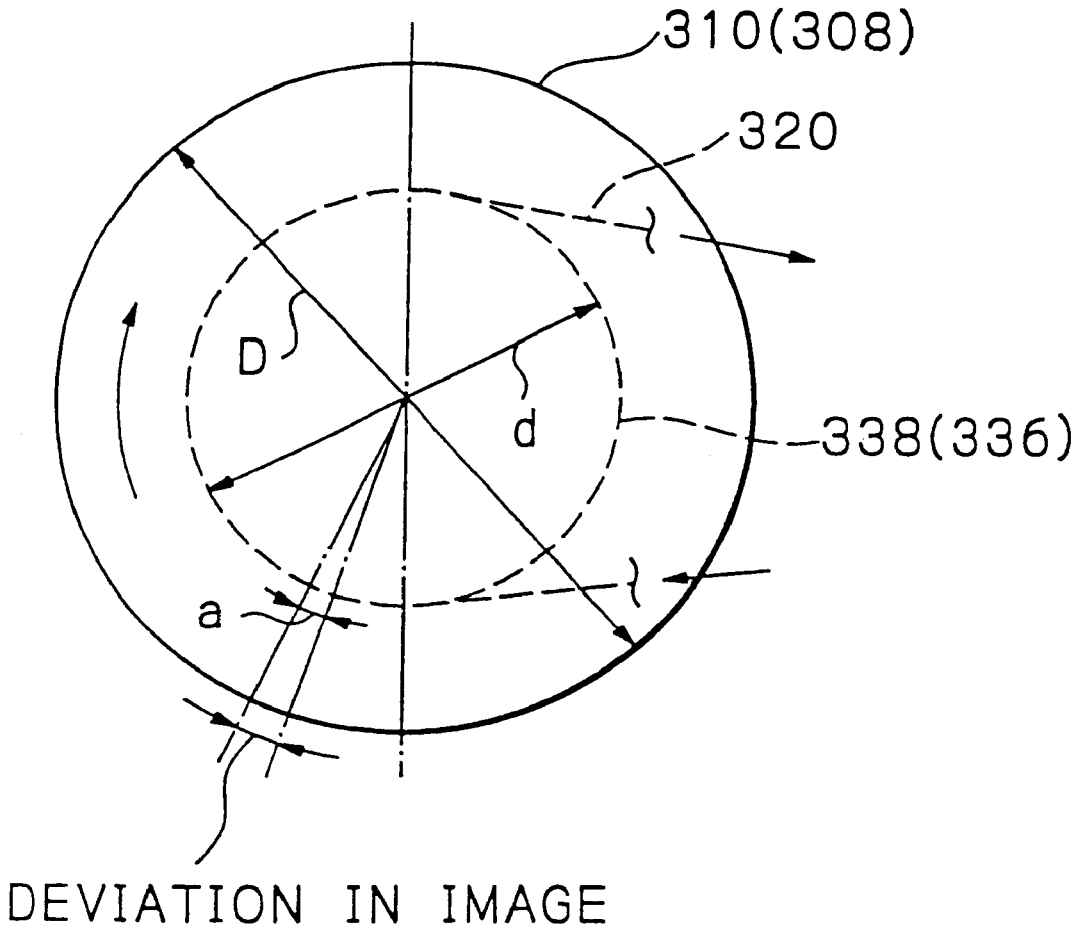
FIG. 11 is a view showing a relation between the pitch circle diameter of a drive pulley included in the illustrative embodiment and the deviation of an image on a print drum.

As shown in FIG. 11, assume that the print drums 308 and 310 each has a diameter D, that the drive pulleys 336 and 338 each has a pitch circle diameter d, and that a deviation a has occurred on the pitch circle of the timing belt 320. Then, the deviation of an image on the print drum 308 or 310 is expressed as $(a \times D/d)$ and inversely proportional to d. The drive pulleys 336 and 338 may therefore be provided with a pitch circle diameter d equal to or greater than the diameter D of the print drums 308 and 310. This, however, increases the cost and thereby impairs or practically cancels the merit of the connecting system using a timing belt. Moreover, if the pitch circle diameter d is increased, then the distance between the print drums 308 and 310 must be increased in order to insure the effective function of the phase adjusting means 322, scaling up the layout.

For the reasons described above, the pitch circle diameter d should lie in a range that is not excessively large or excessively small. For example, assume a printer capable of printing images of size A3 or below. Then, the drive pulleys 336 and 338 each has a diameter of 160 mm to 190 mm. It follows that if D/d=about 1.3, then the pitch circle diameter d of the drive pulleys 336 and 338 is 120 mm to 150 mm.

As for the second experiment in which the print drums 308 and 310 have a diameter of 180 mm, the maximum deviation of an image on the drum 308 or 310 ascribable to the drive of the timing belt 320 is 0.1×180/137.51=0.13 mm in width.

In the first experiment not improving an offset ghost, the ratio of the pitch circle diameter of the drive pulleys 336 and 338 to the number of teeth of the same is 152.79/96=1.59, which is greater than 1. By contrast, in the second experiment improving an offset ghost, the above ratio is 137.51/144=0.95, which is smaller than 1.

To reduce the deviation of rotation of a downstream drum connected to an upstream drum by a timing belt, not only high accuracy but also rigidity great enough to withstand heavy loads are essential. Generally, to cope with heavy loads, it is a common practice to use a thick timing belt having a great pitch or a wide belt having a small pitch.

The illustrative embodiment satisfies the above-stated ratio of the pitch circle diameter to the number of teeth that is smaller than 1. The pitch circle diameter of the drive pulleys 336 and 338 is therefore as great as 120 mm to 150 mm as a relative condition (in the case of a printer assigned to size A3 or below). The illustrative embodiment therefore achieves a sufficient transmission ability even if the timing belt 320 has a small pitch, i.e., even if use is made of a commercially available timing belt whose pitch is 3 mm or less for accurate transmission. Such a timing belt not only increases jitter frequency, but also insures highly accurate position of the core wire of the timing belt 320, thereby accurately reducing an offset ghost ascribable to the timing belt 320.

How the illustrative embodiment reduces an offset ghost ascribable to the eccentricity of rotary members other than the timing belt 320 will be described hereinafter. In the illustrative embodiment, the pulleys 340 and 342 for adjustment each has a number of teeth that is 1/integer of the number of teeth of the drive pulley 336 or 338. Stated another way, the drive pulleys 336 and 338 each has a number of teeth that is an integral multiple of the number of teeth of the pulley 340 or 342. For example, when the drive pulley 336 or 338 has 144 teeth, the pulley 340 or 342 has thirty-six teeth. In this condition, even if the pulleys 340 and 342 are eccentric, no deviation in Aid phase or synchronous rotation occurs between the print drums 308 and 310 because of the relation in the number of teeth. Consequently, an offset ghost is successfully reduced. This will be described more specifically hereinafter with reference to FIGS. 12 and 13.

Figure 12:
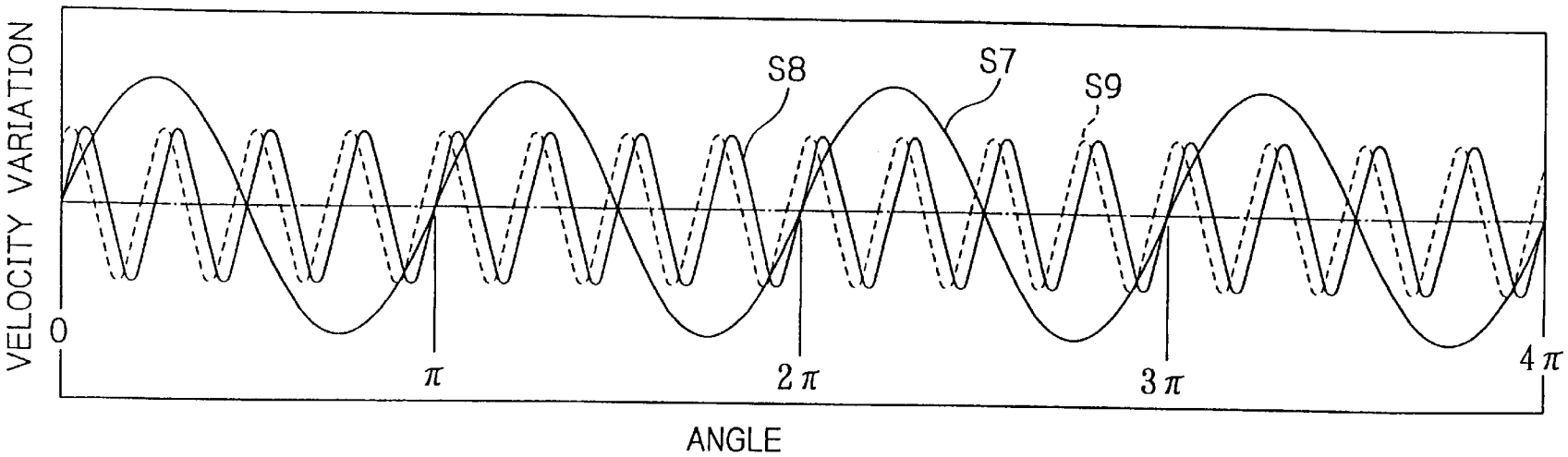
FIG. 12 is a graph showing velocity variations to occur when a pulley for adjustment, for example, is eccentric.

FIG. 12 shows velocity variations ascribable to the eccentricity of the drive pulleys 336 and 338 and that of pulleys 340 and 342 and determined when the ratio of the number of teeth of the pulleys 336 and 338 to that of the pulleys 340 and 342 was 4:1. It is to be noted that FIG. 12 concentrates on the drive pulley 336 and pulley 340 by way of example.

In FIG. 12, a solid waveform S7 shows the velocity variation of the drive pulley 336. A solid waveform S8 shows the velocity variation of the pulley 340; the origin of the waveform S8 is shown as being coincident with the origin of the waveform S7 for better understanding the relation. A phantom waveform S9 shows the velocity variation of the pulley 340 occurred when the drive pulley 336 and pulley 340 were different from each other in the position of eccentricity. If positions of eccentricity are coincident, just four periods of the pulley 340 (342) occur during one period of the drive pulley 336 (338).

Figure 13:
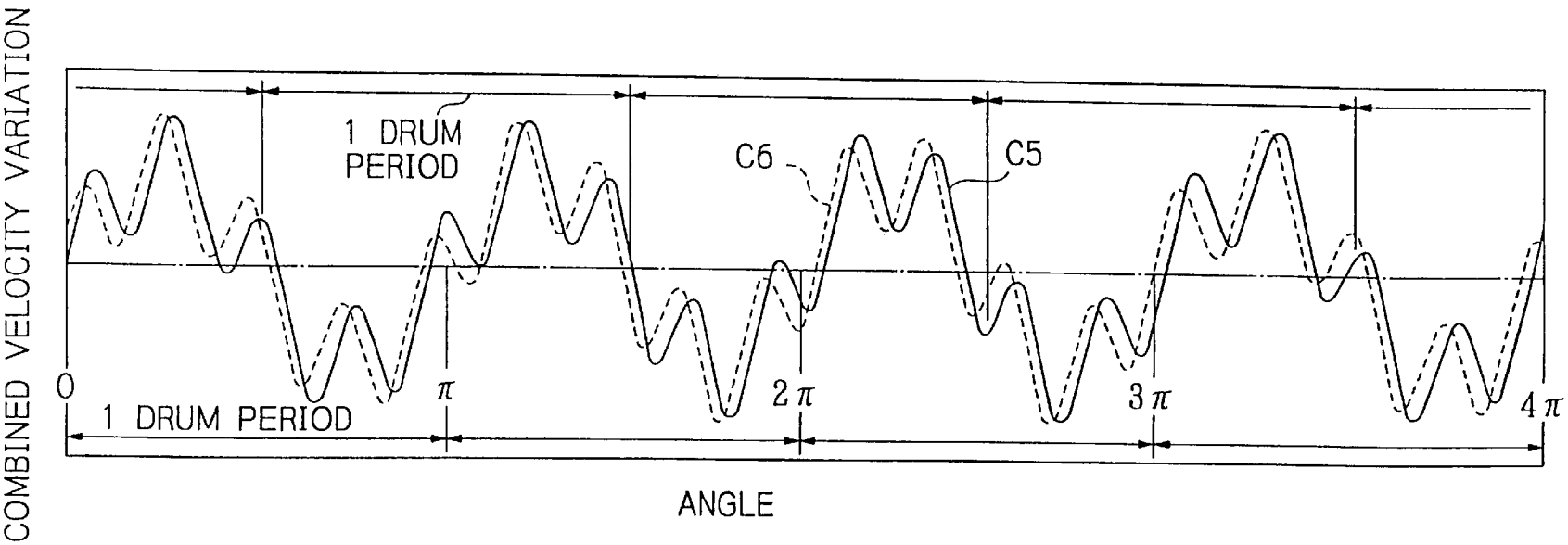
FIG. 13 is a graph showing combined waveforms derived from waveforms of FIG. 12.

FIG. 13 shows a solid waveform C5, which is a combined form of the waveforms S7 and S8 of FIG. 12, and a phantom waveform C6, which is a combined form of the waveforms S8 and S9 of FIG. 12. As shown, wherever one period begins, the velocity varies in the same manner every period, i.e., the velocity varies in the same pattern on both of the waveforms C5 and C6. It follows that the print drums 308 and 310 deviate in the same manner every period, obviating an offset ghost.

The illustrative embodiment includes the pulleys 344 for deflecting the timing belt 320. Even if the pulleys 344 are absent, the previously stated condition of 1/integer successfully reduces an offset ghost for the reasons described above.

Figure 14:
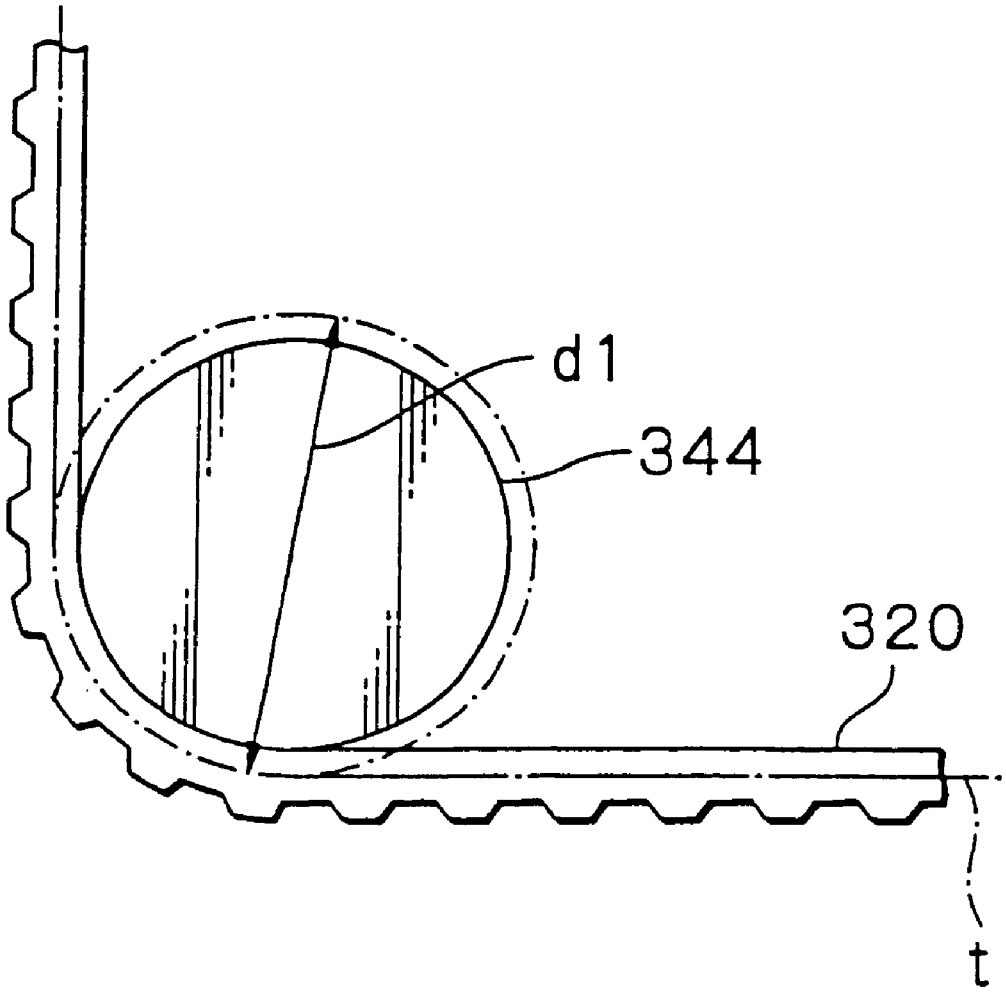
FIG. 14 is a view showing the concept of the pitch circle diameter of a pulley for deflection.

When the pulleys 344 are present, the pitch circle diameter of the pulleys 344 may be selected to be 1/integer of the pitch circle diameter of the drive pulleys 336 and 338 in addition to the previous condition of 1/interger relating to the number of teeth. Stated another way, the drive pulleys 336 and 338 each has a pitch circle diameter that is an integral multiple of the pitch circle diameter of the pulleys 344. For example, when the ratio of the pitch circle diameter of the drive pulleys 336 and 338 to that of the pulleys 344 may be selected to be 5:1. The pulleys 344 have the same pitch circle diameter. In this case, as shown in FIG. 14, the pulleys 344 each has a pitch circle diameter d1 extending to the pitch line (core wire) t of the timing belt 320.

Assume that the pulleys 340 and 342 for adjustment are free from eccentricity, but the pulleys 344 for deflection are eccentric. Then, an offset ghost can be reduced only if the pitch circle diameter of the pulleys 344 are selected to be 1/integer of the pitch circle diameter of the drive pulleys 336 and 338.

144 teeth assigned to the drive pulleys 336 and 338 and 36 teeth assigned to the pulleys 340 and 342 are a preferred example of the ratio of 4:1. If the ratio of 4:1 using other numbers of teeth or another integral ratio of 3:1 or 5:1 is selected in consideration of balance between accuracy and cost, then the number of teeth of the drive pulleys 336 and 38 should be between 108 and 180.

As shown in FIG. 9, the illustrative embodiment connects the print drums 308 and 310 simply with the timing belt 320 passed over the drive pulleys 336 and 338 and rotary members including pulleys 340 and 342 for adjustment and pulleys 344 for deflection. This obviates the need for precision gears. Therefore, even if any one of the above rotary members is eccentric, the ratio of the pitch circle diameter of the individual rotary member to that of the drive pulley 336 and 338 remains to be 1/integer, obviating a phase difference between the print drums 308 and 310. However, the ratio of the number of teeth of the timing belt 320 to that of the drive pulleys 336 and 338 cannot be 1:1 due to the extremely simple connecting scheme. As a result, the eccentricity of the timing belt 320 itself is the only possible cause of phase deviation.

Nevertheless, the timing belt 320 can be implemented by one having a pitch as small as 3 mm or less and a core wire highly accurately positioned. Therefore, an offset ghost ascribable to the timing belt 320 can be reduced. This, coupled with the reduction of an offset ghost ascribable to the other rotary members, promotes accurate reduction of an offset ghost of the entire printer.

While the illustrative embodiment has concentrated on a synchronous driving device arranged between nearby print drums of a printer, it is similarly applicable to any other synchronous drive arrangement between a drive member and a driven member.

In summary, it will be seen that the present invention provides a printer capable of increasing jitter frequency as to the meshing of a timing belt and timing pulleys and insuring highly accurate position of a core wire included in the belt. The printer therefore accurately reduces an offset ghost and other troubles ascribable to the timing belt.

Various modifications will become possible for those skilled in the art after receiving the teachings of the present disclosure without departing from the scope thereof.

What is claimed is:

1. A printer comprising:

a plurality of print drums spaced from each other in a direction of paper conveyance;

toothed drive pulleys each being mounted on one of said plurality of print drums; and a timing belt passed over said toothed drive pulleys for allowing said plurality of print drums to rotate in synchronism with each other, wherein each of said toothed drive pulleys has a pitch circle diameter and a number of teeth related as:

$$d/z<1$$

where d denotes the pitch circle diameter (mm) and z denotes the number of teeth.

2. In a synchronous driving device including a drive member and a driven member, drive pulleys each being mounted on one of said drive member and said driven member, and a timing belt passed over said drive pulleys for causing said drive member and said driven member to rotate in synchronism with each other, wherein each of said drive pulleys has a pitch circle diameter and a number of teeth related as $$d/z<1$$

where d denotes the pitch circle diameter (mm) and z denotes the number of teeth.

3. In a printer including a plurality of print drums spaced from each other in a direction of paper conveyance, toothed drive pulleys each being mounted on one of said plurality of print drums, and a timing belt passed over said toothed drive pulleys for allowing said plurality of print drums to rotate in synchronism with each other, wherein each of said toothed drive pulleys has a pitch circle diameter and a number of teeth related as:

$$d/z<1$$

where d denotes the pitch circle diameter (mm) and z denotes the number of teeth.

4. A device for driving a drive side and a driven side in synchronism, comprising:

a rotary member with toothed drive pulley positioned at the drive side;

a rotary member with toothed drive pulley positioned at the driven side; and a timing belt passed over said toothed drive pulleys for causing said rotary members to rotate in synchronism with each other, wherein each of said toothed drive pulleys has a pitch circle diameter and a number of teeth related as:

$$d/z<1$$

where d denotes the pitch circle diameter (mm) and z denotes a number of teeth.

* * * * *

UNITED STATES PATENT AND TRADEMARK OFFICE

CERTIFICATE OF CORRECTION

PATENT NO. : 6,604,459 B2
DATED : August 12, 2003
INVENTOR(S) : Keiichi Chiba et al.

It is certified that error appears in the above-identified patent and that said Letters Patent is hereby corrected as shown below:

Column 6,
Line 29, please replace “to” with -- as --.

Column 7,
Lines 7 and 28, please replace “damper” with -- clamper --.

Column 9,
Line 49, please delete “Aid”.

Signed and Sealed this

Twentieth Day of July, 2004

JON W. DUDAS
*Acting Director of the United States Patent and Trademark Office*